US009983517B2

(12) United States Patent
Koide et al.

(10) Patent No.: US 9,983,517 B2
(45) Date of Patent: May 29, 2018

(54) IMAGE FORMING APPARATUS

(71) Applicant: FUJI XEROX CO., LTD., Tokyo (JP)

(72) Inventors: Takafumi Koide, Kanagawa (JP); Naoki Ota, Kanagawa (JP); Masataka Kuribayashi, Kanagawa (JP); Yusuke Fukuda, Kanagawa (JP); Yasuhisa Morooka, Kanagawa (JP); Katsuyuki Kitajima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 15/426,824

(22) Filed: Feb. 7, 2017

(65) Prior Publication Data

US 2018/0004129 A1 Jan. 4, 2018

(30) Foreign Application Priority Data

Jul. 1, 2016 (JP) ..... 2016-132010

(51) Int. Cl.

| | |
|---|---|
| ***G03G 9/08*** | (2006.01) |
| ***G03G 15/16*** | (2006.01) |
| ***G03G 9/087*** | (2006.01) |

(52) U.S. Cl.

CPC ..... *G03G 15/162* (2013.01); *G03G 9/08755* (2013.01); *G03G 9/08797* (2013.01); *G03G 15/161* (2013.01)

(58) Field of Classification Search

CPC ..... G03G 9/08755; G03G 9/08797; G03G 15/161; G03G 15/162

USPC ..... 430/109.4

See application file for complete search history.

(56) References Cited

U.S. PATENT DOCUMENTS 5,571,652 A * 11/1996 Asano ..... G03G 9/093 430/109.4

FOREIGN PATENT DOCUMENTS

JP 2010-139603 A 6/2010

* cited by examiner

*Primary Examiner* — Mark A Chapman

(74) *Attorney, Agent, or Firm* — Oliff PLC

(57) ABSTRACT

An image forming apparatus includes a guide unit that guides at least one of an image holding member and an intermediate transfer member to a primary transfer position provided by a primary transfer unit such that a portion of the surface of the image holding member and a portion of the surface of the intermediate transfer member are disposed along with each other, wherein a toner contains a toner particle which contains a binder resin containing a crystalline polyester resin, a coloring agent and a releasing agent, and an external additive, and satisfies Expression: $2 \leq \tan \delta_{P1} \leq 2.5$, wherein $\tan \delta_{P1}$ represents a maximum value of a mechanical loss tangent existing in a range where a complex elastic modulus is from $1 \times 10^6$ Pa to $1 \times 10^8$ Pa, which is measured at an angular frequency of 6.28 rad/sec and a strain amount of 0.3%.

11 Claims, 2 Drawing Sheets

IMAGE FORMING APPARATUS

CROSS-REFERENCE TO RELATED APPLICATIONS

This application is based on and claims priority under 35 USC 119 from Japanese Patent Application No. 2016-132010 filed Jul. 1, 2016.

BACKGROUND

1. Technical Field

The present invention relates to an image forming apparatus.

2. Related Art

Image forming by using an electrophotographic method is performed in such a manner that the entire surface of a photoreceptor is charged, the surface of the photoreceptor is exposed to a laser beam in accordance with image information data so as to form an electrostatic latent image, subsequently, the electrostatic latent image is developed by using a developer including a toner to form a toner image, and lastly the toner image is transferred and fixed to a surface of a recording medium.

SUMMARY

According to an aspect of the invention, there is provided an image forming apparatus including:

an image holding member;

a charge unit that charges a surface of the image holding member;

an electrostatic latent image forming unit that forms an electrostatic latent image on a charged surface of the image holding member;

a developing unit that contains a developer containing a toner, and develops the electrostatic latent image formed on the surface of the image holding member with the developer to form a toner image;

an intermediate transfer member of which the toner image is to be transferred to a surface;

a primary transfer unit that primarily transfers the toner image formed on the surface of the image holding member to the surface of the intermediate transfer member;

a second transfer unit that secondarily transfers the toner image transferred on the surface of the intermediate transfer member to a surface of a recording medium; and a guide unit that is provided on an upstream in the rotation direction of the intermediate transfer member from the primary transfer unit, and guides at least one of the image holding member and the intermediate transfer member up to a primary transfer position provided by the primary transfer unit such that a portion of the surface of the image holding member and a portion of the surface of the intermediate transfer member are disposed along with each other, wherein the toner contains a toner particle which contains a binder resin containing a crystalline polyester resin, a coloring agent and a releasing agent, and an external additive, and satisfies the following Expression (1):

$$2 \leq \tan \delta_{P1} \leq 2.5 \quad (1)$$

wherein $\tan \delta_{P1}$ represents a maximum value of a mechanical loss tangent existing in a range where a complex elastic modulus is from $1\times10^6$ Pa to $1\times10^8$ Pa, which is measured at an angular frequency of 6.28 rad/sec and a strain amount of 0.3%.

BRIEF DESCRIPTION OF THE DRAWINGS

Exemplary embodiments of the present invention will be described in detail based on the following figures, wherein.

DETAILED DESCRIPTION

Figure 1:
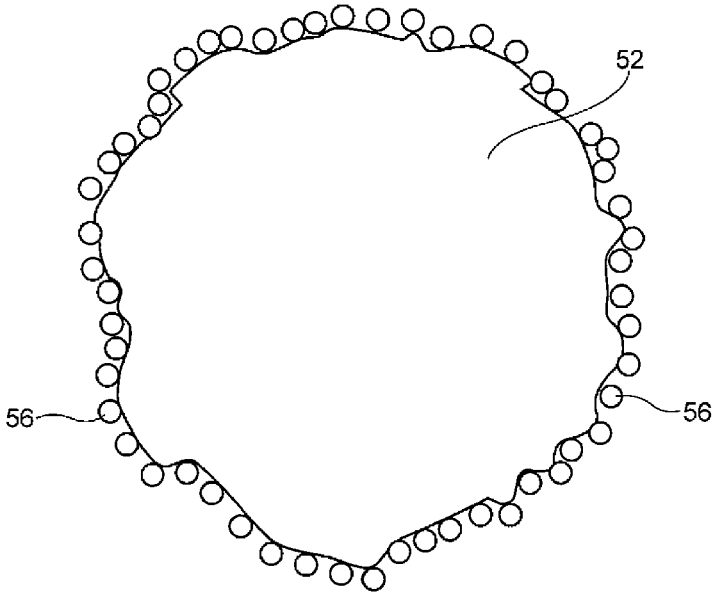
FIG. 1 illustrates a schematic sectional view of a toner particle in a toner for developing an electrostatic charge image used in the exemplary embodiment.

Hereinafter, the exemplary embodiment which is an example of the invention will be described in detail.

Image Forming Apparatus

An image forming apparatus according to an exemplary embodiment includes an image holding member; a charge unit that charges a surface of the image holding member; an electrostatic charge image forming unit that forms an electrostatic charge image on a charged surface of the image holding member; a developing unit that contains an electrostatic charge image developer (hereinafter, simply referred to as "the developer" as well) including a toner for developing an electrostatic charge image (hereinafter, simply referred to as "toner" as well), and develops the electrostatic charge image formed on the surface of the image holding member as a toner image with the electrostatic charge image developer; an intermediate transfer member that transfers the toner image to the surface; a primary transfer unit that primarily transfers the toner image formed on the surface of the image holding member to the surface of the intermediate transfer member; a second transfer unit that secondarily transfers the toner image transferred to the surface of the intermediate transfer member to a surface of a recording medium; and a guide unit that is provided on an upstream in the rotation direction of the intermediate transfer member from the primary transfer unit, and guides at least one of the image holding member and the intermediate transfer member up to a primary transfer position provided by the primary transfer unit such that a portion of the surface of the image holding member and a portion of the surface of the intermediate transfer member are disposed along with each other.

Note that, the toner includes toner particles containing a binder resin containing a crystalline polyester resin, and external additives. Further, the maximum value ($\tan \delta_{P1}$) of a mechanical loss tangent of the toner is from 2 to 2.5 when the complex elastic modulus is in a range of $1\times10^6$ Pa to $1\times10^8$ Pa, which is measured at an angular frequency of 6.28 rad/sec and a strain amount of 0.3%.

From the above-described configuration, the image forming apparatus according to the exemplary embodiment may prevent the deterioration of the transfer properties of the toner image transferred to the intermediate transfer member from the image holding member.

Although the reason is not clear, the following reasons may be presumed.

In the related art, in the intermediate transfer-type image forming apparatus, discharge is generated on the upstream of the primary transfer position, and thus the toner on the image holding member is scattered to the intermediate transfer member in some cases. From the aspect that that toner is prevented from being scattered at the time of the primary transfer, before the primary transfer, that is, before applying a primary transfer voltage, it is known that the guide unit that guides the image holding member on which the toner image is formed and the intermediate transfer member to be disposed along with each other via the toner image is provided.

In the image forming apparatus including such a guide unit, the image holding member and the intermediate transfer member are in contact with each other via a toner image before the primary transfer and at the time of the primary transfer.

In the image forming apparatus including the guide unit, the contact time between the intermediate transfer member and the toner image is long as compared with a case of not including the guide unit, and the influence of the non-electrostatic adhesion of the toner with respect to the surface of the image holding member is increased. For this reason, the toner image is likely attached to the surface of the image holding member, and the transfer properties of the toner image which is to be transferred to the intermediate transfer member are likely to be deteriorated.

The transfer properties are likely to be deteriorated in a case of forming an image having a low image density (for example, equal to or less than 2%), particularly, under the high temperature and high humidity environment (for example, temperature of 28° C. and humidity of 85% RH), and in a case of continuously forming images on both surfaces of the recording medium.

In contrast, the toner to be used in the exemplary embodiment is a toner having the maximum value (tan $\delta_{P1}$) of a mechanical loss tangent in a range of 2 to 2.5 when the complex elastic modulus is in a range of $1\times10^6$ Pa to $1\times10^8$ Pa, which is measured at an angular frequency of 6.28 rad/sec and a strain amount of 0.3%. The fact that the maximum value (tan $\delta_{P1}$) of a mechanical loss tangent is 2 or more in a state where the complex elastic modulus measured under the above-described conditions is within the above-described range is an indicator showing that the elasticity is dominant in viscoelasticity of the toner, that is, the toner is a hard toner and is hard to be softened.

The toner to be used in the exemplary embodiment includes the toner particles and an external additive, and as illustrated in FIG. 1, external additives 56 are externally attached to the surface of a toner particle 52. Since the toner particle 52 is hard and is hard to be softened as described above, and thus the external additive 56 is prevented from being embedded into the surface of the toner particle 52, a spacer effect (an effect of maintaining a distance between the toner particles and the image holding member) is satisfactorily exhibited by the external additive 56. As a result, it is considered that the toner image is prevented from being attached on the surface of the image holding member, and thus the excellent transfer properties of the toner image which is to be transferred to the intermediate transfer member from the image holding member are obtained.

Further, according to the exemplary embodiment, even a case of forming an image having a low image density (for example, equal to or less than 2%) under the high temperature and high humidity environment (for example, temperature of 28° C. and humidity 85% RH), and a case of forming continuously images on both surfaces of the recording medium, the transfer properties of the toner image are prevented from being deteriorated.

The reason is considered as follows.

First, the toner particles are easy to be softened under the high temperature and high humidity environment. Further, when the toner image is formed by the image forming apparatus including the above-described guide unit, in the guide unit, the image holding member and the intermediate transfer member are in contact with each other with the toner image being interposed therebetween, and the contact time between the image holding member and the intermediate transfer member via the toner image is long thus as compared with the image forming apparatus not including the guide unit. Therefore, a load (stress) with respect to the toner image becomes larger. In addition, with respect to the image having a low image density, the number of the toner images formed on the image holding member is a small, and thus the load applied to the toner image becomes larger in the guide unit. That is, in the image forming apparatus including the above-described guide unit, when forming the image having the low image density under the high temperature and high humidity environment, the load is applied to the toner image containing the toner particles softened under the high temperature and high humidity environment over a long period of time, and the toner image is likely to be attached to the image holding member.

In addition, in the case where the images are continuously formed on both surfaces of the recording medium, first, the recording medium is heated at the time of fixing (first time) the image on the front side, and the heated recording medium passes through the second transfer position from the intermediate transfer member at the time of forming the image (second time) on the rear side again, and thus the intermediate transfer member is warmed by the heat applied to the recording medium. In this way, when the toner image comes in contact with the surface of the warmed intermediate transfer member, the toner particles are also warmed and are easy to be softened. Further, in the image forming apparatus including the guide unit, the contact time between the toner image and the intermediate transfer member is long as compared with a case of the image forming apparatus not including the guide unit, and thus the time for applying the heat from the warmed intermediate transfer member also becomes longer, and thereby the toner particles are easy to be softened. In other words, in the image forming apparatus including the aforementioned guide unit, when the images are continuously formed on both surfaces of the recording medium, the intermediate transfer member is warmed by the heat applied to the recording medium by the fixing unit, and the contact time between the warmed intermediate transfer member and the toner image also becomes longer. For this reason, the toner particles are warmed by the intermediate transfer member and thus are easy to be softened. As a result, the toner image is easily attached to the image holding member.

However, in the exemplary embodiment, the toner particle 52 is hard and is hard to be softened as described above, and thus even under the high temperature and high humidity environment, or even in a case where the images are continuously formed on both surfaces of the recording medium, the toner particle 52 is hard to be softened, that is, the external additive 56 is prevented from being embedded into the surface of the toner particle 52. Further, also in the case of forming the image having the low image density, the external additive 56 is prevented from being embedded into the surface of the toner particle 52. As a result, it is considered that a spacer effect (an effect of maintaining a distance between the toner particles and the image holding member) is satisfactorily exhibited by the external additive 56, the toner image is prevented from being attached on the surface of the image holding member, and thus the excellent transfer properties of the toner image which is to be transferred to the intermediate transfer member from the image holding member are obtained.

As described above, in the image forming apparatus according to the exemplary embodiment, it is possible to prevent the deterioration of the transfer properties of the toner image which is to be transferred to the intermediate transfer member from the image holding member by using the toner satisfying the above-described requirements.

With respect to the above-described image forming apparatus having the guide unit, the toner is prevented from being scattered at the time of the primary transfer, and thus it is possible to form a high quality image.

Hereinafter, the image forming apparatus according to the exemplary embodiment will be specifically described.

Toner for Developing Electrostatic Image

First, in the exemplary embodiment, a toner which is contained in a developing device and is used in a developing step will be specifically described.

The toner in the exemplary embodiment contains the binder resin containing the crystalline polyester resin, and has a maximum value (tan $\delta_{P1}$) of a mechanical loss tangent in a range of 2 to 2.5 when the complex elastic modulus is in a range of $1\times10^6$ Pa to $1\times10^8$ Pa, which is measured at an angular frequency of 6.28 rad/sec and a strain amount of 0.3%.

Maximum Value (Tan $\delta_{p1}$ and Tan $\delta_{p2}$) of Mechanical Loss Tangent In the toner in the exemplary embodiment, the maximum value (tan $\delta_{P1}$) of a mechanical loss tangent of the toner is from 2 to 2.5 when the complex elastic modulus is in a range of $1\times10^6$ Pa to $1\times10^8$ Pa, which is measured at an angular frequency of 6.28 rad/sec and a strain amount of 0.3%. Note that, the maximum value (tan $\delta_{P1}$) of a mechanical loss tangent of the toner is preferably in a range of 2 to 2.3.

When the maximum value (tan $\delta_{P1}$) of a mechanical loss tangent of the toner is 2 or more, it is possible to prevent the deterioration of the transfer properties of the toner image which is to be transferred to the intermediate transfer member from the image holding member.

On the other hand, when the maximum value (tan $\delta_{P1}$) of a mechanical loss tangent of the toner is 2.5 or less, it is possible to prevent the deterioration of the transfer properties by preventing the charge injection to the toner.

In addition, in the toner in the exemplary embodiment, the maximum value (tan $\delta_{P2}$) of the mechanical loss tangent is preferably from 2 to 2.3, and more preferably from 2 to 2.2 when the complex elastic modulus is in a range of $1\times10^6$ Pa to $1\times10^7$ Pa, which is measured at an angular frequency of 6.28 rad/sec and a strain amount of 0.3%.

When the maximum value (tan $\delta_{P2}$) of the mechanical loss tangent is 2 or more, it is possible to prevent the deterioration of the transfer properties of the toner image which is to be transferred to the intermediate transfer member from the image holding member.

On the other hand, when the maximum value (tan $\delta_{P2}$) of a mechanical loss tangent of the toner is 2.3 or less, the charge injection to the toner is prevented, and the deterioration of the transfer properties is prevented.

Method of Measuring Mechanical Loss Tangent

Here, the calculation of the mechanical loss tangent value is performed based on the dynamic viscoelasticity measured according to a sinusoidal vibration method. In the measurement of the dynamic viscoelasticity, a measuring apparatus ARES manufactured by Rheometric Scientific Inc is used, and the dynamic viscoelasticity is measured by setting toner formed into a tablet is set on a parallel plate having a diameter of 8 mm, and imparting the sinusoidal vibration at a vibration frequency of 6.28 rad/sec to the plate after setting the normal force to be 0. The measurement is started at 60° C., and continued up to 150° C. The measurement time interval is set to be 30 seconds, the temperature rise is set to be 1° C./min, and the strain amount is set to be 0.3% so as to obtain the values of the complex elastic modulus and the mechanical loss tangent, and from the obtained values, the maximum value (tan $\delta_{P1}$) of the mechanical loss tangent when the complex elastic modulus is in a range of $1\times10^6$ Pa to $1\times10^8$ Pa, and the maximum value (tan $\delta_{P2}$) of the mechanical loss tangent when the complex elastic modulus is in a range of $1\times10^6$ Pa to $1\times10^7$ Pa are calculated.

Method of Controlling Maximum Values (Tan $\delta_{P1}$ and Tan $\delta_{P2}$) of Mechanical Loss Tangent A method of controlling the maximum value (tan $\delta_{P1}$) of the mechanical loss tangent and the maximum value (tan $\delta_{P2}$) of the mechanical loss tangent of the toner to be in the above-described ranges will be described. The control method is not particularly limited; however, in a case of obtaining toner according to an aggregation and coalescence method described later, a method of using a ester compound (for example, esters formed of higher alcohols having 12 to 30 carbon atoms and higher fatty acids having 12 to 30 carbon atoms, such as stearyl stearate, palmityl palmitate, behenyl behenate, and stearyl montanate; esters formed of higher fatty acids having 12 to 30 carbon atoms and lower monoalcohols, such as butyl stearate, isobutyl behenate, propyl montanate, and 2-ethylhexyl oleate; esters formed of higher fatty acid having 12 to 30 carbon atoms and polyol such as montanic acid monoethylene glycol ester, ethylene glycol distearate, monostearic acid glyceride, monobehenic acid glyceride, tripalmitic acid glyceride, pentaerythritol monobehenate, pentaerythritol dilinoleate, pentaerythritol trioleate, and pentaerythritol tetrastearate; esters formed of higher fatty acids having 12 to 30 carbon atoms and a multimer of polyol, such as diethylene glycol monobehenate, diethylene glycol dibehenate, dipropylene glycol monostearate, distearic acid diglyceride, tetrastearic acid triglyceride, hexabehenic acid tetraglyceride, and decastearic acid deca glyceride; esters formed of higher fatty acids having 12 to 30 carbon atoms and a monomer or a multimer (a short-chain functional group may be contained) of polyol, such as glycerin monoacetomonostearate, glycerin monoacetomonolinoleate, and diglycerin monoacetodistearate; sorbitan higher fatty acid esters such as sorbitan monostearate, sorbitan dibehenate, and sorbitan trioleate; cholesterol higher fatty acid esters such as cholesteryl stearate, cholesteryl oleate, and cholesteryl linoleate) in a mixed dispersion in which a resin particle dispersion and the like are mixed with each other, and adjusting the amount at the time of forming aggregated particles.

The ester compound such as stearyl stearate is attached to the surface of the resin particle at the time of forming the aggregated particles, and reduces an apparent glass transition temperature of the surface so as to improve the stability of the aggregated particles and the responsiveness to heat of particles attached to the surface of resin. For this reason, it is considered that the maximum value (tan $\delta_{P1}$ and tan $\delta_{P2}$) of the mechanical loss tangent under the above-described conditions may be increased.

In addition, the ester compound may be set as an ester compound dispersion in which the ester compound is dispersed in advance, and the ester compound dispersion may be added into the mixture dispersion at the time of forming the aggregated particles.

In addition, examples of the control method also include a method of incorporating a metal oxide (for example, water glass, silica, alumina, titania, calcium carbonate, magnesium carbonate, tricalcium phosphate, and cerium oxide) in the mixed dispersion, with the amount at the time of forming aggregated particles being adjusted.

The metal oxide such as water glass tends to exist at an appropriate distance in the resin particle at the time of forming the aggregated particles, and therefore, acts to lower the viscosity of the resin molecules when being heated during the fixing. For this reason, the maximum values (tan $\delta_{P1}$ and tan $\delta_{P2}$) of the mechanical loss tangent are increased under the above-described conditions.

As a resin particle dispersion using the aggregation and coalescence method, a dispersion in which crystalline resin-amorphous resin mixed particles are dispersed is preferably used. The dispersion is obtained in such a manner that a crystalline resin containing a crystalline polyester resin and an amorphous resin are dispersed in a dispersion medium, and then, the dispersion medium containing the crystalline resin and the amorphous resin is subjected to the phase inversion emulsification. Since both the crystalline resin and the amorphous resin are dispersed in the dispersion medium and then the dispersion medium is subjected to the phase inversion emulsification, it is possible to obtain well-mixed crystalline resin-amorphous resin mixed particles as compared with a case where the crystalline resin and amorphous resin are independently dispersed in the dispersion mediums to prepare the respective dispersions and the dispersions are mixed and then subjected to the phase inversion emulsification.

Further, the maximum value (tan $\delta_{P1}$ and tan $\delta_{P2}$) of the mechanical loss tangent is also adjusted by the ratio of the crystalline resin to the amorphous resin, the molecular amount of the crystalline resin or the amorphous resin, and the crosslinking degree.

Dynamic Complex Viscosity ($\eta^*_{-30}$ and $\eta^*_{-10}$)

With respect to the toner in the exemplary embodiment, the dynamic complex viscosity ($\eta^*_{-30}$) of the toner is preferably $3\times10^7$ Pa·s or more at a temperature of (the melting temperature of a crystalline polyester resin contained in the toner −30° C.), and the dynamic complex viscosity ($\eta^*_{-10}$) is preferably in a range of $1\times10^6$ Pa·s to $5\times10^7$ Pa·s at a temperature of (the melting temperature of a crystalline polyester resin −10° C.)

The dynamic complex viscosity ($\eta^*_{-30}$) of the toner at a temperature of (the melting temperature of the crystalline polyester resin −30°) may be regarded as the dynamic complex viscosity of the toner in a state before being melted, that is, in a solid state; on the other hand, the dynamic complex viscosity ($\eta^*_{-10}$) at a temperature of (the melting temperature of the crystalline polyester resin −10° C.) may be regarded as the dynamic complex viscosity of the toner in a state of starting to be melted. In addition, in the toner, the fact that the dynamic complex viscosity ($\eta^*_{-30}$) in the solid state is equal to or greater than the above-described lower limit value and the dynamic complex viscosity ($\eta^*_{-10}$) in the state of starting to be melted is in a range of the above-described range is an indicator showing that the toner is hard to be softened.

Even in the image forming apparatus including the guide unit, it is considered that the external additive is prevented from being embedded into the toner particle in the position of the guide unit (that is, an area where the toner image is interposed between the image holding member and the intermediate transfer member), and as a result, it is easy to prevent the deterioration of the transfer properties of the toner image which is to be transferred to the intermediate transfer member from the image holding member.

When the dynamic complex viscosity ($\eta^*_{-30}$) of the toner at a temperature of (the melting temperature of the crystalline polyester resin −30° C.) is $3\times10^7$ Pa·s or more, the compatibility of the crystalline polyester resin with the other resin is deteriorated, and thus a partial decrease in the glass transition temperature of the resin is prevented. For this reason, a difference hardly appears in the adhesion of the external additive on the toner surface, and for example, the occurrence of transfer unevenness is prevented, which is a preferable point.

Further, when the dynamic complex viscosity ($\eta^*_{-10}$) is $1\times10^6$ Pa·s or more at a temperature of (the melting temperature of the crystalline polyester resin −10° C.), even at the temperature close to the melting temperature, the toner is hard to be softened, and the transfer properties of the toner image which is to be transferred to the intermediate transfer member from the image holding member are prevented from being deteriorated.

On the other hand, when the dynamic complex viscosity ($\eta^*_{-10}$) of the toner at the melting temperature of −10° C. of the crystalline polyester resin is $5\times10^7$ Pa·s or less, the fixing temperature of the entire toners is decreased to the proper temperature, and the surface gloss is appropriately controlled. Thus, it is possible to prevent the difference in gloss caused by the difference in the toner applied amount, which is a preferable point.

Note that, the dynamic complex viscosity ($\eta^*_{-10}$)) under the condition of a temperature of (the melting temperature of the crystalline polyester resin −10° C.) is preferably in a range of $2\times10^6$ Pa·s to $3\times10^7$ Pa·s, and more preferably in a range of $4\times10^6$ Pa·s to $2\times10^7$ Pa·s.

In addition, the dynamic complex viscosity ($\eta^*_{-30}$) at a temperature of (the melting temperature of the crystalline polyester resin −30° C.) is preferably $1\times10^8$ Pa·s or more, and more preferably $5\times10^8$ Pa·s or more.

Method of Measuring Dynamic Complex Viscosity

The measurement of the dynamic complex viscosity ($\eta^*$) is performed in such a manner that by using a rheometer, under the condition of frequency of 1 rad/second, and heating is performed at a heating rate of 1° C./minute from the melting temperature of the crystalline polyester resin contained in the toner, and the dynamic complex viscosity is measured for each degree. A measurement strain is set to be equal to or less than 20%, and parallel plates of 8 mmφ and 25 mmφ are separately used in accordance with a measurement torque.

Control Method of Dynamic Complex Viscosity ($\eta^*_{-30}$ and $\eta^*_{-10}$)

A method of controlling the dynamic complex viscosity ($\eta^*_{-30}$) and the dynamic complex viscosity ($\eta^*_{-10}$) in the toner to be in the above-described ranges is not particularly limited, and for example, in a case of a toner having a core-shell structure, there is a method by adjusting the ratio of the binder resin in a core and a shell and the molecular weight of the binder resin, particularly the molecular weight of the crystalline resin contained in the core. In addition, examples of the above-described method also include a method of adjusting the acid value of the crystalline resin, the presence or absence of the addition of a coagulant used in the aggregation and coalescence step at the time of preparing the toner, or a kind thereof.

From the viewpoint of controlling the dynamic complex viscosity ($\eta^*_{-30}$ and $\eta^*_{-10}$), a method of incorporating an ester compound such as stearyl stearate as described above and adjusting the amount thereof, and a method of incorporating the metal oxide such as the above-described water glass and adjusting the amount thereof are preferably used.

Further, from the viewpoint of controlling the dynamic complex viscosity ($\eta^*_{-30}$ and $\eta^*_{-10}$), as a resin particle dispersion using the aggregation and coalescence method, a dispersion in which crystalline resin-amorphous resin mixed particles are dispersed is preferably used. The dispersion is obtained by dispersing a crystalline resin containing a crystalline polyester resin and an amorphous resin in a dispersion medium, and then, performing the phase inversion emulsification on the dispersion medium.

Next, components of the toner in the exemplary embodiment will be described.

The toner according to the exemplary embodiment is formed of toner particles, and if necessary, an external additive.

Toner Particle

The toner particle is formed of a binder resin, and if necessary, a colorant, a release agent, and other additives. In addition, the binder resin contains at least a crystalline polyester resin.

Binder Resin

Examples of the binder resin include vinyl resins formed of homopolymer of monomers such as styrenes (for example, styrene, para-chloro styrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, a polyester resin, a polyurethane resin, a polyamide resin, a cellulose resin, a polyether resin, and a modified rosin, a mixture thereof with the above-described vinyl resins, or a graft polymer obtained by polymerizing a vinyl monomer with the coexistence of such non-vinyl resins.

These binder resins may be used singly or in combination of two or more types thereof.

Examples of the crystalline polyester resin include a well-known polyester resin. The crystalline polyester resin may be used in combination with the amorphous polyester resin. The content of the crystalline polyester resin may be in a range of 2% by weight to 40% by weight (preferably in a range of 2% by weight to 20% by weight) with respect to the entirety of the binder resin.

Note that, "crystalline" of the resin means having not a stepwise endothermic change but a clear endothermic peak in the differential scanning calorimetry (DSC), and specifically, means that the half-value width of the endothermic peak is within 10° C. when measured at a heating rate of 10 (° C./min).

On the other hand, "amorphous" of the resin means that the half value width is higher than 10° C., the endothermic change is stepwise, or a clear endothermic peak is not recognized.

Amorphous Polyester Resin

Examples of the amorphous polyester resin include condensation polymers of polyvalent carboxylic acid and polyol. A commercially available product or a synthesized product may be used as the amorphous polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid having a crosslinked structure or a branched structure may be used in combination with dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acid may be used singly or in combination of two or more types thereof.

Examples of the polyol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are more preferably used as the polyol.

As the polyol, a tri- or higher-valent polyol having a crosslinked structure or a branched structure may be used in combination with diol. Examples of the tri- or higher-valent polyol include glycerin, trimethylolpropane, and pentaerythritol.

The polyol may be used singly or in combination of two or more types thereof.

The glass transition temperature (Tg) of the amorphous polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from "Extrapolated glass transition onset temperature" described in the method of obtaining a glass transition temperature in JIS K 7121-1987 "Testing methods for transition temperatures of plastics".

The weight average molecular weight (Mw) of the amorphous polyester resin is preferably from 5,000 to 1,000,000, and more preferably from 7,000 to 500,000.

The number average molecular weight (Mn) of the amorphous polyester resin is preferably from 2,000 to 100,000.

The molecular weight distribution Mw/Mn of the amorphous polyester resin is preferably from 1.5 to 100, and more preferably from 2 to 60.

The weight average molecular weight and the number average molecular weight are measured by gel permeation chromatography (GPC). The molecular weight measurement by GPC is performed using GPC: HLC-8120 GPC, manufactured by Tosoh Corporation as a measuring device, column: TSK gel Super HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method may be used to prepare the amorphous polyester resin. Specific examples thereof include a method of conducting a reaction at a polymerization temperature set to be in a range of 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Crystalline Polyester Resin

Examples of the crystalline polyester resin include a polycondensate of polyvalent carboxylic acid and polyol. Note that, as the crystalline polyester resin, a commercially available product may be used or, synthesized product may be used.

Here, the crystalline polyester resin easily forms a crystalline structure, and thus a polycondensate obtained by using a polymerizable monomer having a linear aliphatic group rather than a polymerizable monomer having an aromatic group is preferable.

Examples of the polyvalent carboxylic acid include aliphatic dicarboxylic acid (for example, oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acid (for example, dibasic acid such as phthalic acid, isophthalic acid, terephthalic acid, or naphthalene-2,6-dicarboxylic acid), anhydrides thereof, or lower alkyl esters (having, for example, from 1 to 5 carbon atoms) thereof.

As the polyvalent carboxylic acid, tri- or higher-valent carboxylic acid having a crosslinked structure or a branched structure may be used in combination with dicarboxylic acid. Examples of tri-valent carboxylic acid include aromatic carboxylic acids (for example, 1,2,3-benzenetricarboxylic acid, 1,2,4-benzenetricarboxylic acid, 1,2,4-naphthalenetricarboxylic acid), anhydrides thereof, or lower alkyl esters (having, for example, from 1 to 5 carbon atoms) thereof.

As the polyvalent carboxylic acid, a dicarboxylic acid having a sulfonic acid group or a dicarboxylic acid having an ethylenic double bond may be used together with the dicarboxylic acid.

The polyvalent carboxylic acid may be used singly or in combination of two or more types thereof.

Examples of the polyol include an aliphatic diol (for example, a linear aliphatic diol having a carbon number of 7 to 20 in the main chain portion). Examples of the aliphatic dial include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, examples of the aliphatic diol preferably include 1,8-octanediol, 1,9-nonanediol, and 1,10-decanediol.

As the polyol, a tri- or higher-valent polyol having a crosslinked structure or a branched structure may be used in combination with diol. Examples of the tri- or higher-valent polyol include glycerin, trimethylolethane, trimethylolpropane, and pentaerythritol.

The polyol may be used singly or in combination of two or more types thereof.

Here, polyol may have the aliphatic diol of which the content is preferably 80 mol % or more, and further preferably 90 mol % or more.

The melting temperature of the crystalline polyester resin is preferably in a range of 50° C. to 100° C., is further preferably in a range of 55° C. to 90° C., and is still further in a range of 60° C. to 85° C.

Note that, the melting temperature is obtained from a DSC curve obtained by differential scanning calorimetry (DSC), and specifically obtained from "Melting peak temperature" described in the method of obtaining a melting temperature in JIS K 7121-1987 "Testing methods for transition temperatures of plastics".

The weight average molecular weight (Mw) of the crystalline polyester resin is preferably in a range of 6,000 to 35,000.

The crystalline polyester resin may be obtained according to a well-known preparing method similarly to the amorphous polyester resin.

The content of the binder resin is preferably from 40% by weight to 95% by weight, more preferably from 50% by weight to 90% by weight, and most preferably from 60% by weight to 85% by weight, with respect to the entirety of the toner particles.

Colorant

Examples of the colorant includes various types of pigments such as carbon black, chrome yellow, Hansa yellow, benzidine yellow, threne yellow, quinoline yellow, pigment yellow, Permanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate, or various types of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

The colorant may be used singly or in combination of two or more types thereof.

As the colorant, if necessary, a surface-treated colorant may be used, or a dispersant may be used in combination. Further, as the colorant, plural types of colorants may be used in combination.

The content of the colorant is preferably in a range of 1% by weight to 30% by weight, and is further preferably in a range of 3% by weight to 15% by weight with respect to the entirety of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

The melting temperature of the release agent is preferably from 50° C. to 110° C., and more preferably from 60° C. to 100° C.

The melting temperature is obtained from a DSC curve obtained by differential scanning calorimetry (DSC), and specifically obtained from "Melting peak temperature" described in the method of obtaining a melting temperature in JIS K 7121-1987 "testing methods for transition temperatures of plastics".

The content of the release agent is preferably from 1% by weight to 20% by weight, and more preferably from 5% by weight to 15% by weight with respect to the entirety of the toner particles.

Other Additives

Examples of other additives include well-known additives such as a magnetic material, a charge-controlling agent, and an inorganic powder. These additives are contained in the toner particle as internal additives.

Properties of Toner Particles

The toner particles may be toner particles having a single-layer structure, or toner particles having a so-called core•shell structure composed of a core (core particle) and a coating layer (shell layer) coated on the core.

Here, the toner particles having a core•shell structure is preferably composed of, for example, a core containing a binder resin, and if necessary, other additives such as a colorant and a release agent and a coating layer containing a binder resin.

The volume average particle diameter (D50v) of the toner particles is preferably from 2 μm to 10 μm, and more preferably from 4 μm to 8 μm.

Various average particle diameters and various particle diameter distribution indices of the toner particles are measured using a COULTER MULTISIZER II (manufactured by Beckman Coulter, Inc.) and ISOTON-II (manufactured by Beckman Coulter, Inc.) as an electrolyte.

In the measurement, a measurement sample in a range of 0.5 mg to 50 mg is added to 2 ml of a 5% aqueous solution of surfactant (preferably sodium alkylbenzene sulfonate) as a dispersing agent. The obtained material is added to the electrolyte in a range of 100 ml to 150 ml.

The electrolyte in which the sample is suspended is subjected to a dispersion treatment using an ultrasonic disperser for 1 minute, and a particle diameter distribution of particles having a particle diameter of from 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle diameter ranges (channels) separated based on the measured particle diameter distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle diameter distribution index (GSDv) is calculated as $(D84v/D16v)^{1/2}$, while a number average particle diameter distribution index (GSDp) is calculated as $(D84p/D16p)^{1/2}$.

The average circularity of the toner particles is preferably in a range of 0.94 to 1.00, and is further preferably in a range of 0.95 to 0.98.

The average circularity of the toner particles is calculated by (circumference length of circle equivalent diameter)/(circumference length) [(circumference length of circle having the same projection area as that of particle image)/(circumference length of particle projected image)]. Specifically, the aforementioned value is measured according to the following method.

The average circularity of the toner particles is calculated by using a flow particle image analyzer (measured by FPIA-2100 manufactured by Sysmex Corporation), which first, suctions and collects the toner particles to be measured so as to form flat flow, then captures a particle image as a static image by instantaneously emitting strobe light, and then performs image analysis of the obtained particle image. 3,500 particles are sampled for calculating the average circularity.

In a case where the toner contains an external additive, the toner (the developer) to be measured is dispersed in the water containing a surfactant, and then the water is subjected to an ultrasonic treatment so as to obtain the toner particles in which the external additive is removed.

External Additives

A number average particle diameter of the inorganic particles is preferably from 10 nm to 200 nm.

When the number average particle diameter of the inorganic particles is from 10 nm to 200 nm, the spacer effect of the extra additive is produced and it is possible to prevent the deterioration of the transfer properties of the toner image which is to be transferred to the intermediate transfer member from the image holding member.

The number average particle diameter of the inorganic particles is further preferably from 80 nm to 160 nm, and more preferably from 110 nm to 140 nm.

In addition, the external additive may contain the inorganic particles having a number average particle diameter being not from 10 nm to 200 nm, in combination with the inorganic particles having a number average particle diameter of from 10 nm to 200 nm, to improve the flow property of the toner.

In a case of using the inorganic particles separated from the toner, the number average particle diameter of the inorganic particles is measured using a COULTER MULTISIZER II (manufactured by Beckman Coulter, Inc.) When the toner is directly observed, 100 primary particles are observed with a scanning electron microscope (SEM) (S-4100 manufactured by Hitachi, Ltd.) and image thereof is captured, this image is put in an image analyzer (LUZEX III manufactured by Nireco Corporation), and a number average particle diameter of the equivalent circle diameters obtained by the image analysis of the primary particles is calculated. The magnification of the electron microscope is adjusted so that approximately 10 to 50 inorganic particles are shown in 1 visual filed and the equivalent circle diameters of the primary particles are determined in combination of observation in plural visual fields.

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)$ n, $Al_2O_3.2SiO_2$, $CaCO_3$, $MgCO_3$, $BaSO_4$, and $MgSO_4$.

Among them, silica particles are preferable. Examples of the silica particles include fumed silica, colloidal silica, and silica gel, and there is no particular limitation to use.

Surfaces of the inorganic particles as an external additive are preferably treated with a hydrophobizing agent. The hydrophobizing treatment is performed by, for example, dipping the inorganic particles in a hydrophobizing agent. The hydrophobization treating agent is not particularly limited and examples thereof include a silane coupling agent, silicone oil, a titanate coupling agent, and an aluminum coupling agent. These may be used alone or in combination of two or more kinds thereof.

Generally, the amount of the hydrophobization treating agent is, for example, from 1 part by weight to 10 parts by weight with respect to 100 parts by weight of the inorganic particles.

Examples of the external additive include a resin particle (resin particle such as polystyrene, polymethyl methacrylate (PMMA), and melamine resin), a cleaning aid (for example, metal salts of higher fatty acids typified by zinc stearate, and particles having fluorine high molecular weight polymer).

The amount of the external additive is, for example, preferably in a range of 0.01% by weight to 5% by weight, and is further preferably in a range of 0.01% by weight to 2.0% by weight with respect to the toner particles.

Preparing Method of Toner

Next, the method of preparing the toner will be described.

The toner is obtained by additionally adding the external additive to the toner particles after preparing the toner particles.

The toner particles may be prepared according to any one of a drying method (for example, a kneading and pulvering method) a wetting method (for example, an aggregation and coalescence method, a suspension polymerization method, and a dissolution suspension method). The preparing method of the toner particles is not particularly limited, and well-known method may be employed.

Among them, the toner particles may be suitably obtained according to the aggregation and coalescence method.

In addition, from the viewpoint of adjusting the maximum value (tan $\delta_{P1}$ and tan $\delta_{P2}$) of the above-described mechanical loss tangent and the dynamic complex viscosity ($\eta^*_{-30}$ and $\eta^*_{-10}$) of the toner to be in the above-described ranges, as a resin particle dispersion to be used according to the aggregation and coalescence method, a dispersion in which crystalline resin-amorphous resin mixed particles are dispersed is preferably used. The dispersion is obtained in such a manner that a crystalline resin containing a crystalline polyester resin and an amorphous resin are dispersed in a dispersion medium, and then, the dispersion medium containing the crystalline resin and the amorphous resin is subjected to the phase inversion emulsification.

Further, in a case where the toner is obtained according to the aggregation and coalescence method, at the time of forming aggregated particles, a method of incorporating an ester compound such as stearyl stearate as described above and adjusting the amount thereof, and a method of incorporating the metal oxide such as the above-described water glass and adjusting the amount thereof are preferably used.

Specifically, for example, in a case where the toner particles are prepared according to the aggregation and coalescence method, the toner particles are prepared through the steps. The steps include a step (a resin particle dispersion preparing step) of preparing a resin particle dispersion in which resin particles constituting the binder resin are dispersed, a step (an aggregated particles forming step) of forming aggregated particles by aggregating the resin particles (other particles if necessary), in the resin particle dispersion (in the dispersion in which other particle dispersions are mixed, if necessary); and a step (a coalescence step) of coalescing aggregated particles by heating an aggregated particle dispersion in which aggregated particles are dispersed so as to form toner particles.

Hereinafter, the respective steps will be described in detail.

In the following description, a method of obtaining toner particles including the colorant and the release agent will be described; however, the colorant and the release agent are used if necessary. Other additives other than the colorant and the release agent may also be used.

Resin Particle Dispersion Preparing Step

First, along with a resin particle dispersion in which the binder resin particles are dispersed, for example, a colorant particle dispersion in which colorant particles are dispersed and a release agent particle dispersion in which the release agent particles are dispersed are prepared.

Here, the resin particle dispersion is, for example, prepared by dispersing the resin particles in a dispersion medium with a surfactant.

An aqueous medium is used, for example, as the dispersion medium used in the resin particle dispersion.

Examples of the aqueous medium include water such as distilled water, ion exchange water, or the like, alcohols, and the like. The medium may be used singly or in combination of two or more types thereof.

Examples of the surfactant include an anionic surfactant such as sulfate, sulfonate, phosphate, and soap; a cationic surfactant such as amine salt and quaternary ammonium salt; and a nonionic surfactant such as polyethylene glycol, alkyl phenol ethylene oxide adduct, and polyol. Among them, the anionic surfactant and the cationic surfactant are particularly preferable. The nonionic surfactant may be used in combination with the anionic surfactant or the cationic surfactant.

The surfactant may be used singly or in combination of two or more types thereof.

Regarding the resin particle dispersion, as a method of dispersing the resin particles in the dispersion medium, a general dispersing method using, for example, a rotary shearing-type homogenizer, or a ball mill, a sand mill, or a DYNO mill, is exemplified. Depending on the type of the resin particles, the resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to the organic continuous phase (O phase); and adding an aqueous medium (W phase) to thereby form a discontinuous phase and convert the resin (so-called phase inversion) from W/O to O/W, thus dispersing the resin as particles in the aqueous medium.

In addition, in a case where the phase inversion emulsification method is used, a dispersion in which a crystalline resin and an amorphous resin are dispersed is preferably used. The above dispersion in which a crystalline resin and an amorphous resin are dispersed is obtained in such a manner that the crystalline resin and the amorphous resin are dispersed in the dispersion medium, and then, the dispersion medium containing the crystalline resin and the amorphous resin is subjected to the phase inversion emulsification.

The volume average particle diameter of the resin particles dispersed in the resin particle dispersion is, for example, preferably from 0.01 μm to 1 μm, more preferably from 0.08 μm to 0.8 μm, and most preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entire particles is measured as a volume average particle diameter D50v. The volume average particle diameter of the particles in other dispersion liquids is also measured in the same manner.

The content of the resin particles contained in the resin particle dispersion is, for example, preferably in a range of 5% by weight to 50% by weight, and further preferably in a range of 10% by weight to 40% by weight.

For example, the colorant particle dispersion and the release agent particle dispersion are also prepared in the same manner as in the case of the resin particle dispersion. That is, the resin particles in the resin particle dispersion are the same as the particles of the colorant dispersed in the colorant dispersion, and the release agent particle dispersed in the release agent particle dispersion, in terms of the volume average particle diameter, the dispersion medium, the dispersing method, and the content of the particles in the resin particle dispersion.

The colorant particle dispersion and the release agent particle dispersion are also prepared in the same manner as in the case of the resin particle dispersion. That is, the volume average particle diameter, the dispersion medium, the dispersing method, and the content of the particles with respect to the resin particles in the resin particle dispersion described above may be applied to those of the colorant particles dispersed in the colorant particle dispersion and the release agent particles dispersed in the release agent particle dispersion.

Aggregated Particles Forming Step

Next, the resin particle dispersion, the colorant particle dispersion, and the release agent particle dispersion are mixed with each other.

The resin particles, the colorant particles, and the release agent particle are heterogeneously aggregated in the mixed dispersion, thereby forming aggregated particles having a diameter near a target toner particle diameter and including the resin particles, the colorant particles, and the release agent particles.

In addition, in the aggregated particles forming step, it is preferred that an ester compound such as stearyl stearate or a metal oxide such as water glass is contained in the mixed dispersion in which the resin particle dispersion and the like are mixed with each other.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated at a temperature of a glass transition temperature of the resin particles (specifically, for example, in a range of from a temperature 30° C. lower than the glass transition temperature to a temperature 10° C. lower than the glass transition temperature with respect to the resin particles) to aggregate the particles dispersed in the mixed dispersion, thereby forming the aggregated particles.

In the aggregated particle forming step, for example, the aggregating agent may be added at room temperature (for example, 25° C.) while stirring the mixed dispersion with a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant, an inorganic metal salt, a divalent or more metal complex, which has an opposite polarity to the polarity of the surfactant used as the dispersing agent to be added to the mixed dispersion. Particularly, when a metal complex is used as the aggregating agent, the amount of the surfactant to be used is reduced and charging characteristics are improved.

An additive for forming a complex or a similar bond with a metal ion contained in the aggregating agent may be used, if necessary. A chelating agent is suitably used as the additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The additive amount of the chelating agent is, for example, preferably in a range of 0.01 parts by weight to 5.0 parts by weight, and more preferably in a range of 0.1 parts by weight or more and less than 3.0 parts by weight, with respect to 100 parts by weight of the resin particles.

Coalescence Step

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to perform the coalesce on the aggregated particles and form toner particles.

The toner particles are obtained through the foregoing steps.

Note that, the toner particles may be obtained through a step of forming second aggregated particles in such a manner that an aggregated particle dispersion in which the aggregated particles are dispersed is obtained, the aggregated particle dispersion and a resin particle dispersion in which resin particles are dispersed are mixed, and the mixtures are aggregated so that the resin particles are attached on the surface of the aggregated particle, and a step of forming the toner particles having a core/shell structure by heating a second aggregated particle dispersion in which the second aggregated particles are dispersed, thereby coalescing the second aggregated particles.

Here, after the coalescence step ends, the toner particles formed in the solution are subjected to a washing step, a solid-liquid separation step, and a drying step, which are well known, and thus dry toner particles are obtained.

In the washing step, displacement washing with ion exchange water may be sufficiently performed from the viewpoint of charging properties. In addition, the solid-liquid separation step is not particularly limited, but suction filtration, pressure filtration, or the like is preferably performed from the viewpoint of productivity. The method of the drying step is also not particularly limited, but freeze drying, airflow drying, fluidized drying, vibration-type fluidized drying, or the like may be performed from the viewpoint of productivity.

The toner according to the exemplary embodiment is prepared by adding and mixing, for example, an external additive to the obtained dry toner particles, if necessary. The mixing may be performed with, for example, a V-blender, a HENSCHEL mixer, a LODIGE MIXER, or the like. Furthermore, if necessary, coarse particles of the toner may be removed by using a vibration classifier, a wind classifier, or the like.

Electrostatic Charge Image Developer

The electrostatic charge image developer according to the exemplary embodiment includes at least the toner according to the exemplary embodiment.

The electrostatic charge image developer according to the exemplary embodiment may be a one-component developer containing only the toner according to the exemplary embodiment, or a two-component developer obtained by mixing the toner with a carrier.

The carrier is not particularly limited, and a well-known carrier may be used. Examples of the carrier include a coating carrier in which the surface of the core formed of magnetic particle is coated with the coating resin; a magnetic particle dispersion-type carrier in which the magnetic particle are dispersed and distributed in the matrix resin; and a resin impregnated-type carrier in which a resin is impregnated into the porous magnetic particles.

Note that, the magnetic particle dispersion-type carrier and the resin impregnated-type carrier may be a carrier in which particles which form the above carrier are set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, and a straight silicone resin formed by containing an organosiloxane bond or the modified products thereof, a fluorine resin, polyester, polycarbonate, a phenol resin, and an epoxy resin.

Other additives such as the conductive particles may be contained in the coating resin and the matrix resin.

Examples of the conductive particle include metal such as gold, silver, and copper, carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution in the kneader coater and removing a solvent.

The mixing ratio (weight ratio) of the toner to the carrier in the two-component developer is preferably in a range of toner: carrier=1:100 to 30:100, and is further preferably in a range of 3:100 to 20:100.

Image Forming Apparatus

Next, a configuration of the image forming apparatus in the exemplary embodiment will be described.

Configuration of Image Forming Apparatus

As the image forming apparatus according to the exemplary embodiment, well-known image forming apparatuses such as an apparatus including fixing unit that fixes a toner image transferred on a surface of a recording medium; an apparatus includes an erasing unit that erases charges by irradiating the surface of the image holding member with erasing light after transferring the toner image and before being charged; an apparatus including a cleaning unit that cleans the surface of the image holding member after transferring the toner image and before being charged; and an apparatus including an image holding member-heating material that increases the temperature of the image holding member so as to decrease a relative temperature are employed.

In the image forming apparatus according to the exemplary embodiment, for example, a unit including the image holding member may be a cartridge structure (process cartridge) which is detachable from the image forming apparatus. In addition to the image holding member, examples of the process cartridge include at least one selected from the group consisting of a charge unit, an electrostatic latent image forming unit, and a developing unit may be included in the process cartridge.

Hereinafter, an example of the image forming apparatus of the exemplary embodiment will be described; however, the invention is not limited thereto. Note that, in the drawing, major portions will be described, and others will not be described.

Figure 2:
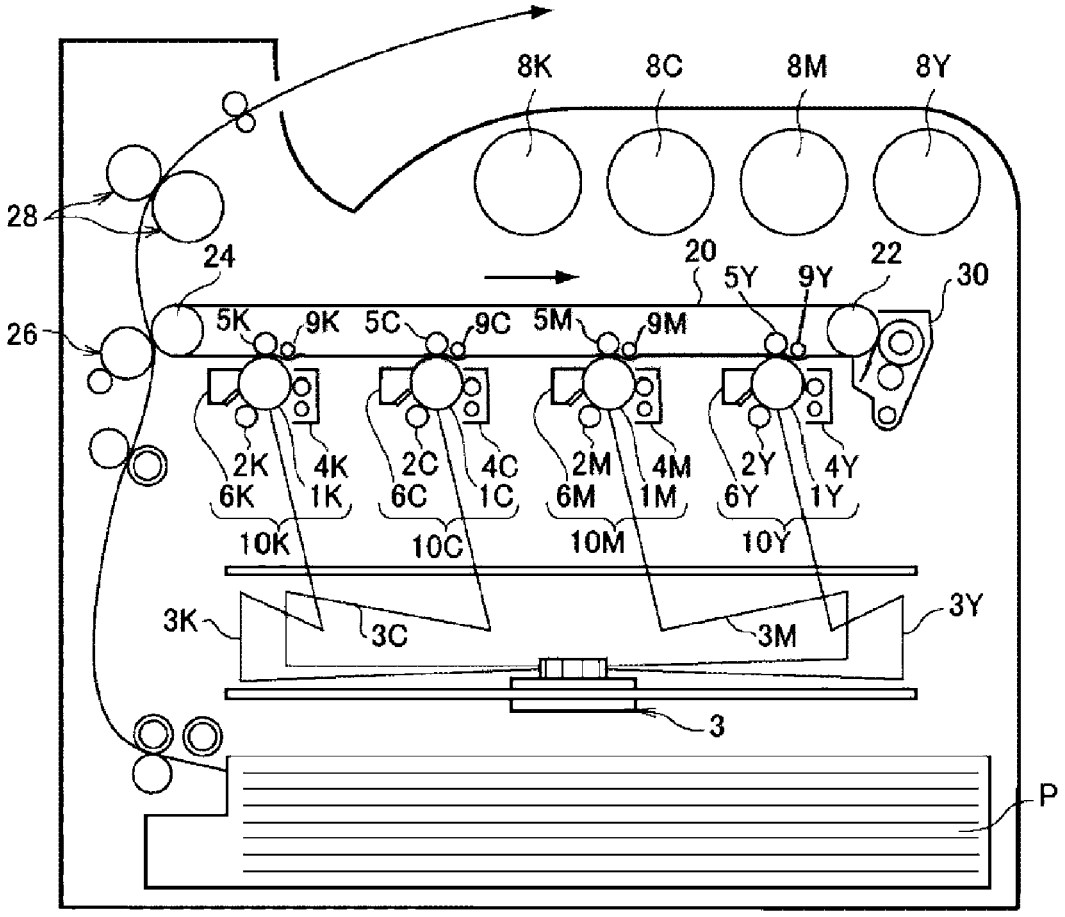
FIG. 2 illustrates the structure of an image forming apparatus according to an exemplary embodiment of the present invention.

FIG. 2 illustrates the structure of an image forming apparatus according to an exemplary embodiment.

The image forming apparatus as illustrated in FIG. 2 has four electrophotographic image forming units 10Y, 10M, 10C, and 10K (image forming unit) that output an image for each color of yellow (Y), magenta (M), cyan (C), and black (K) based on color separated image data. These image forming units 10Y, 10M, 10C, and 10K (hereinafter, simply referred to as a "unit" in some cases) are arranged apart from each other by a predetermined distance in the horizontal direction. The units 10Y, 10M, 10C, and 10K may be the process cartridge which is detachable from the image forming apparatus.

As an intermediate transfer member, an intermediate transfer belt 20 passing through the respective units is extended upward in the drawing of the respective units 10Y, 10M, 10C, and 10K. The intermediate transfer belt 20 is provided to be wound onto a support roller 24 and a driving roller 22 which are disposed apart from each other in the horizontal direction in the drawing, and travels to the direction from the first unit 10Y to the fourth unit 10K. In addition, a force is applied to the support roller 24 in the direction apart from the driving roller 22 by a spring (not shown), and thus a tension is applied to the intermediate transfer belt 20 which is wound onto both. Further, an intermediate transfer member cleaning device 30 is provided on the side surface of the image holding member of the intermediate transfer belt 20 so as to face the driving roller 22.

Each of developing devices (an example of the developing unit) 4Y, 4M, 4C, and 4K of the each of the units 10Y, 10M, 10C, and 10K contains the developer containing the toner. In addition, four colors toner of yellow, magenta, cyan, and black stored in toner cartridges 8Y, 8M, 8C, and 8K are correspondingly supplied to each of the developing devices 4Y, 4M, 4C, and 4K.

The first to fourth units 10Y, 10M, 10C, and 10K have the same configuration as each other, and thus the first unit 10Y for forming a yellow image disposed on the upstream side the travel direction of the intermediate transfer belt will be representatively described. Note that, the description for the second to fourth units 10M, 10C, and 10K will be omitted by denoting reference numeral with magenta (M), cyan (C), and black (K) instead of yellow (Y) to the same part as that of the first unit 10Y.

The first unit 10Y has a photoreceptor 1Y acting as an image holding member.

Around the photoreceptor 1Y, a charging roll (an example of the charge unit) 2Y that charges a surface of the photoreceptor 1Y to a predetermined potential; an exposure device (an example of the electrostatic latent image forming unit) 3 that exposes the charged surface with laser beams 3Y based on a color-separated image signal to form an the electrostatic latent image; a developing device (an example of the developing unit) 4Y that supplies a charged toner to the electrostatic latent image, and develops the electrostatic latent image so as to form a toner image; a guide roller (an example of the guide unit) 9Y that guides a portion of a surface of an image holding member on which a toner image is formed and a portion of a surface of an intermediate transfer belt 20 to be disposed along with each other via the toner image; a primary transfer roller 5Y (an example of the primary transfer unit) that applies a primarily transfer voltage, and primarily transfers the toner image, which is interposed between the photoreceptor 1Y and the intermediate transfer belt 20, onto the intermediate transfer belt 20; and a photoreceptor cleaning device (an example of the cleaning unit) 6Y that removes a residue remaining on the surface of the photoreceptor 1Y after the primary transfer are sequentially disposed.

The primary transfer roller 5Y is disposed inside the intermediate transfer belt 20, and is provided at a position facing the photoreceptor 1Y. Further, bias power supply (not shown) which applies the primary transfer voltage is connected to each of the primary transfer rollers 5Y, 5M, 5C, and 5K. The bias power supply changes the primary transfer voltage which is applied to the primary transfer roller by control of a control unit (not shown).

The guide roller 9Y is disposed inside the intermediate transfer belt 20, and guides a portion of the surface of the intermediate transfer belt 20 such that the portion of the surface of the intermediate transfer belt 20 faces a portion of the surface of the photoreceptor 1Y by deforming a portion of the intermediate transfer belt 20.

Figure 3:
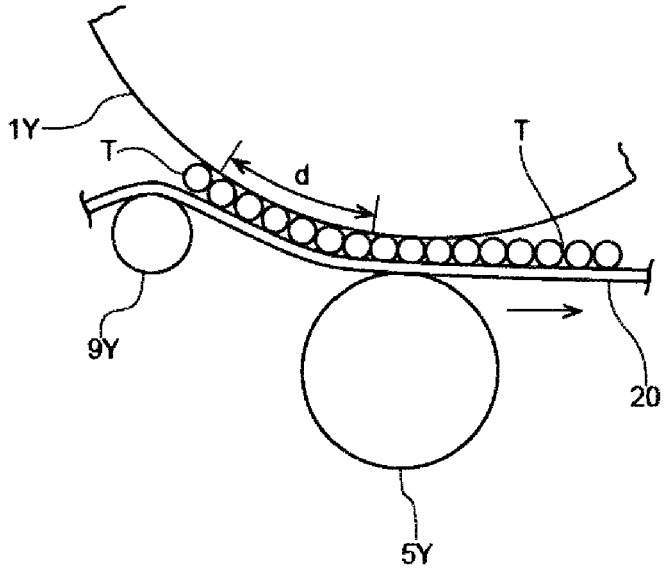
FIG. 3 illustrates a configuration diagram of disposition of a guide unit in the exemplary embodiment.

Here, an example of a state of disposition of the guide unit will be more specifically described with reference to FIG. 3. FIG. 3 illustrates the structure of a state of disposition of the guide roller 9Y in the image forming unit 10Y.

As illustrated in FIG. 3, the guide roller 9Y is disposed on the upstream side of the primary transfer roller 5Y on the upstream side (upstream side in the arrow direction in FIG. 3) of the intermediate transfer belt 20 in the rotation direction, and deforms the intermediate transfer belt 20 such that the intermediate transfer belt 20 is disposed along with a portion of the circumstance of the photoreceptor 1Y. In this case, the developed toner image T is interposed between the photoreceptor 1Y and the intermediate transfer belt 20, and the heat from the intermediate transfer belt 20 is transferred to the toner image T.

Here, a distance in which a portion of the surface of the photoreceptor 1Y and a portion of the surface of the intermediate transfer belt 20 are disposed along with each other (d in FIG. 3: a distance in which the surface of the photoreceptor 1Y and the intermediate transfer belt 20 contact with each other via the toner image T, namely, a distance to a pressure-contacting part (the primary transfer position) by the transfer roller 5Y) may be determined depending on rotational speed of the photoreceptor 1Y, the outer diameter of the photoreceptor, and the like, but is preferably 5 mm or more, and is more preferably from 5 mm to 10 mm.

In the exemplary embodiment, all of the first to fourth units 10Y, 10M, 10C, and 10K include the guide units (the guide rollers 9Y, 9M, 9C, and 9K), and in the unit including such a guide unit, as the developer included in the developing device, the developer including toner according to the exemplary embodiment (that is, the toner which includes the binder resin containing the crystalline polyester resin, and of which the maximum value (tan $\delta_{P1}$) of a mechanical loss tangent is from 2 to 2.5 when the complex elastic modulus is in a range of $1\times10^6$ Pa to $1\times10^8$ Pa which is measured at an angular frequency of 6.28 rad/sec and a strain amount of 0.3%) may be employed.

Hereinafter, an operation of forming a yellow image in the first unit 10Y will be described.

First, before starting the operation, the surface of the photoreceptor 1Y is charged with the potential in a range of −600 V to −800 V by the charging roller 2Y.

The photoreceptor 1Y is formed by laminating a photosensitive layer on the conductive substrate (for example, volume resistivity: $1\times10^{-6}$ Ωcm at 20° C.). This photosensitive layer is normally high resistance (general resin resistance), but when being irradiated with the laser beam 3Y, the photoreceptor 1Y has the properties of changing the resistivity of a portion which is irradiated with the laser beam. In this regard, in accordance with image data for yellow transmitted from the control unit (not shown), the laser beam 3Y is output to the charged surface of the photoreceptor 1Y via the exposure device 3. The photosensitive layer on the surface of the photoreceptor 1Y is irradiated with the laser beam 3Y, and thereby, the electrostatic latent image of a yellow image pattern is formed on the surface of the photoreceptor 1Y.

The electrostatic latent image means an image formed on the charged surface of the photoreceptor 1Y, in which resistivity of a portion of the photosensitive layer to be irradiated with the laser beam 3Y is decreased and the charges for charging the surface of the photoreceptor 1Y move; while charges of a portion which is not irradiated with the laser beam 3Y remain, namely the electrostatic latent image is a so-called negative latent image.

The electrostatic latent image formed on the photoreceptor 1Y is rotated to the predetermined developing position in accordance with the traveling of the photoreceptor 1Y. Further, at the developing position, the electrostatic latent image on the photoreceptor 1Y is visualized (developed) as a toner image by the developing device 4Y.

The developing device 4Y contains, for example, a developer including at least a yellow toner and a carrier. The yellow toner is frictionally charged by being agitated in the developing device 4Y to have a charge with the same polarity (negative polarity) as the charge that is charged on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, so that the latent image is developed with the yellow toner. The photoreceptor 1Y on which the yellow toner image is formed is subsequently driven at a predetermined speed. In addition, the toner image developed on the photoreceptor 1Y contacts with the intermediate transfer belt 20 which is deformed by the guide roller 9Y, and subsequently transported to the predetermined primary transfer position (a pressure-contacting part (a nip portion) by the transfer roller 5Y).

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, so that the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed by a photoreceptor cleaning device 6Y to be collected.

The primary transfer voltages that are applied to the primary transfer rollers 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the four units reaches a secondary transfer part that is composed of the intermediate transfer belt 20, the support roller 24 contacting the inner surface of the intermediate transfer belt, and a secondary transfer roller (an example of the secondary transfer unit) 26 disposed on the image holding surface side of the intermediate transfer belt 20.

Meanwhile, a recording sheet (an example of the recording medium) P is supplied to a gap between the secondary transfer roller 26 and the intermediate transfer belt 20 by a supply mechanism at a predetermined timing, and a secondary transfer bias is applied to the support roller 24. The transfer bias applied at this time has the same polarity (−) as the toner polarity (−), and an electrostatic force toward the recording sheet P from the intermediate transfer belt 20 acts on the toner image, so that the toner image on the intermediate transfer belt 20 is transferred onto the recording sheet P. In this case, the secondary transfer bias is determined depending on the resistance detected by a resistance detecting unit (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, so that a fixed image is formed. Examples of the recording sheet P to which the toner image is transferred include plain paper that is used in electrophotographic copying machine, printers, and the like, and as a recording medium, an OHP sheet is also exemplified other than the recording sheet P.

The recording sheet P on which the fixing of the color image is completed is discharged toward a discharge part, and a series of the color image forming operations end.

Here, in FIGS. 2 and 3, an example of including a drum (cylindrical)-shaped photoreceptor (an example of the image holding member), and a belt-shaped intermediate transfer member is described; however, the exemplary embodiment is not limited to the example.

For example, the belt-shaped photoreceptor and the drum-shaped intermediate transfer member may be combined with each other, and the belt-shaped photoreceptor and the belt-shaped intermediate transfer member may be combined with each other.

In a case of the former, the guide unit may deform the belt-shaped photoreceptor so as to be disposed along with the circumference of the drum-shaped intermediate transfer member.

In addition, in a case of the latter, the guide unit deforms at least one of the belt-shaped photoreceptor and the belt-shaped intermediate transfer member such that the circumference of the belt-shaped photoreceptor and the circumference of the belt-shaped intermediate transfer member are disposed along with each other.

Next, the components (the image holding member, the charge unit, the electrostatic latent image forming unit, the developing unit, the primary and secondary transfer units, the intermediate transfer member, and the developer) for constituting the image forming apparatus according to the exemplary embodiment will be specifically described.

Note that, the description is made without reference numerals.

Image Holding Member

As the photoreceptor in the exemplary embodiment, a well-known image holding member is employed.

The photoreceptor may be formed into a drum (cylindrical) shape as illustrated FIGS. 2 and 3, or may be formed into a belt shape.

The photoreceptor includes a photosensitive layer on the outer peripheral surface of the conductive substrate, and if necessary, it may also include an undercoat layer provided between the conductive substrate and the photosensitive layer, an intermediate layer provided between the undercoat layer and the photosensitive layer, and a protective layer provided on the surface of the photosensitive layer, in addition to the photosensitive layer.

Further, the photosensitive layer may be a function separation-type (a multi-layer type) photosensitive layer including a charge generation layer having charge generation capability and a charge transport layer having charge transport capability, or may be a function integrated-type (a single layer type) photosensitive layer having the charge generation capability and the charge transport capability.

A moving speed of a surface of the image holding member is preferably 300 mm/s or more.

Charge Unit

In the image forming apparatus as illustrated in FIG. 2, the charging rollers 2Y, 2M, 2C, and 2K are used as the charge unit; however, the charge unit is not limited to the charging rollers.

Other examples of the charge unit include a contact-type charging device using a conductive or semiconductive charging brush, a charging film, a charging rubber blade, a charging tube or the like.

In addition, well-known charger such as a non-contact type roller charger a scorotron charger using corona discharge and a corotron charger are also used.

Electrostatic Latent Image Forming Unit

In the image forming apparatus as illustrated in FIG. 2, the exposure device 3 which may emit the laser beams 3Y, 3M, 3C, and 3K is used as the electrostatic latent image forming unit; however, the electrostatic latent image forming unit is not limited to the above exposure device.

Examples of the exposure device include an optical device that exposes the surface of the electrophotographic photoreceptor in a predetermined image with the light such as a semiconductor laser beam, LED light, and liquid crystal shutter light. The wavelength of the light source is set to be within a spectral sensitivity region of the electrophotographic photoreceptor. The wavelength of the semiconductor laser beam is mainly near-infrared having an oscillation wavelength in the vicinity of 780 nm. However, the wavelength is not limited, the oscillation wavelength laser having a level of 600 nm, or laser having the oscillation wavelength in a range of 400 nm to 450 nm as a blue laser may be also used. In addition, a surface emission-type laser light source capable of outputting a multi-beam is also effective to form a color image.

Developing Unit

Examples of the developing unit (a developing device) include a general developing device that develops an image by bring a developer into contact with or not in contact with the image holding member.

Examples of the developing unit include a general developing device that develops an image by bring a developer into contact with or not in contact with the image holding member. The example of the developing device is not particularly limited as long as it has the above-described functions, and the type thereof is selected depending on the purpose. For example, examples thereof include a well-known developing device having a function of attaching a one-component developer or a two-component developer to the electrophotographic photoreceptor by using a brush, a roller, and the like. Among them, it is preferable to use a developing roller which holds the developer on the surface.

Here, the developer to be used in the developing unit may be an one-component developer containing only a toner, and may be a two component developer including the toner and a carrier. In addition, the developer may be magnetic or non-magnetic.

Guide Unit

As the guide unit, the guide rollers 9Y, 9M, 9C, and 9K which are disposed inside the intermediate transfer belt 20 are used in the image forming apparatus as illustrated in FIG. 2; however, the guide unit is not limited thereto.

In addition, the shape of the guide unit is not limited to a roll shape, and examples thereof include a plate shape and an arc shape.

As described above, the guide unit may guide the photoreceptor and the intermediate transfer member to be disposed along with each other by deforming at least one of the photoreceptor and the intermediate transfer member before the primary transfer, and thus the position of the guide unit may be determined in accordance with the shape of the photoreceptor and the intermediate transfer member. The position of the guide unit is not limited to the inside of the intermediate transfer member, but may be disposed inside the photoreceptor, or may be disposed both of the inside of the intermediate transfer member and the inside of the photoreceptor.

The above guide unit is provided so as to prevent the toner from being scattered at the time of the primary transfer, and the image forming apparatus according to the exemplary embodiment may be provided with a guide unit having the same configuration so as to prevent the toner from being scattered at the time of the secondary transfer.

Primary and Secondary Transfer Units

In the image forming apparatus as illustrated in FIG. 2, the intermediate transfer type device using the intermediate transfer belt 20 is employed as the primary and secondary transfer units, and the primary transfer rollers 5Y, 5M, 5C, and 5K, and the secondary transfer roller 26 are used; however, the transfer unit is not limited to the intermediate transfer type device.

Other examples of the primary and secondary transfer units include a transfer unit which utilizes a direct transfer method using transfer corotron, a transfer roller, or the like, or a transfer belt method for electrostatically adsorbing and transporting a recording medium and transferring the toner image present on the photoreceptor.

Examples of the primary and secondary transfer units include well-known transfer charger such as a contact type transfer charger using a belt, a film, a rubber blade, and the like in addition to the roller, a scorotron transfer charger using corona discharge, and a corotron transfer charger are also used.

Intermediate Transfer Member

As the intermediate transfer member, the intermediate transfer belt 20 is used in the image forming apparatus as illustrated in FIG. 2, but the exemplary embodiment is not limited thereto.

Other examples of the intermediate transfer member include a drum-shaped intermediate transfer member.

For an intermediate transfer belt, usable are those containing polyimide, polyamideimide, polycarbonate, polyarylate, polyester, rubber, or the like, to which semi-conductivity is imparted.

EXAMPLES

Hereinafter, the exemplary embodiment will be further specifically described with reference to Examples and Comparative Examples; however, the exemplary embodiment is not limited to the above described Examples and Comparative Examples.

Preparation of Toner 1

Preparation of Crystalline Resin (A)

First, 100 parts by weight of dimethyl sebacate, 67.8 parts by weight of hexane diol, and 0.10 parts by weight of dibutyl tin oxide are allowed to react with each other under nitrogen atmosphere at 185° C. for five hours in a three-necked flask while removing water generated during the reaction to the outside, then the temperature is increased to 220° C. while slowly reducing pressure, and the reaction is performed for six hours, followed by cooling. Thus, a crystalline resin (A) having the weight average molecular weight of 33,700 is prepared.

Note that, the melting temperature of the crystalline resin (A) is obtained from a DSC curve obtained by differential scanning calorimetry (DSC), and specifically obtained from "Melting peak temperature" described in the method of obtaining a melting temperature in JIS K 7121-1987 "Testing methods for transition temperatures of plastics", and the obtained melting temperature is 71° C.

Preparation of Amorphous Resin (1)

First, 60 parts by weight of dimethyl terephthalate, 82 parts by weight of dimethyl fumarate, 34 parts by weight of dodecenyl succinic anhydride, 137 parts by weight of bisphenol A ethylene oxide adduct, 191 parts by weight of bisphenol A propylene oxide adduct, and 0.3 parts by weight of dibutyl tin oxide are allowed to react with each other under nitrogen atmosphere at 180° C. for three hours in a three-necked flask while removing water generated during the reaction to the outside, the temperature is increased up to 240° C. while slowly reducing pressure, and the reaction is performed for two hours, followed by cooling. Thus, an amorphous resin (1) having the weight average molecular weight of 17,100 is prepared.

Preparation of Colorant Dispersion

Further, a colorant dispersion is prepared by mixing 50 parts by weight cyan pigment (copper phthalocyanine, C.I. Pigment blue 15:3, prepared by Dainichiseika Color & Chemicals Mfg. Co., Ltd.), 5 parts by weight of nonionic surfactant NONIPOL 400 (prepared by Kao Corporation), and 200 parts by weight of ion exchange water, dispersing the mixture for about one hour by using a high-pressure impact disperser ULTIMAIZER (HJP30006, manufactured by Sugino Machine Ltd.), and adjusting the moisture amount.

Preparation of Release Agent Dispersion

A release agent dispersion having a water amount adjusted such that the concentration of the release agent becomes 20% by weight in the dispersion in which the release agent having the volume average particle diameter of 250 nm is dispersed is prepared by heating a solution at 120° C., the solution being prepared by mixing 60 parts by weight of paraffin wax (HNP9, manufactured by Nippon Seiro, Co., Ltd., melting temperature of 77° C.), 4 parts by weight of anionic surfactant (NEOGEN RK, manufactured by Dai-Ichi Kogyo Seiyaku Co., Ltd.), and 200 parts by weight of ion exchange water, subjecting the solution to a dispersing treatment with a homogenizer (ULTRA-TURRAX T50, manufactured by IKA Ltd.), and then a dispersing treatment with MANTON-GAULIN high pressure homogenizer (manufactured by Manton Gaulin Mfg Company Inc) under the condition of 120° C., 350 kg/cm$^2$, and one hour.

Preparation of Ester Compound Dispersion 100 parts by weight of stearyl stearate (prepared by NOF Corporation), 55 parts by weight of methyl ethyl ketone, and 23 parts by weight of n-propyl alcohol are put into a three-necked flask, the resin is dissolved in the three-necked flask while being stirred, 350 parts by weight of ion exchange water is added into the three-necked flask. Then, the resultant is dispersed by using a homogenizer (ULTRA-TURRAX T50, manufactured by IKA Ltd.), and removing the solvent is performed. The volume average particle diameter is 195 nm. An ester compound dispersion having the solid concentration of 25% is prepared by adding ion exchange water to the resultant.

Preparation of Crystalline Resin/Amorphous Resin Mixed Particle Dispersion (A1)

A crystalline resin/amorphous resin mixed particle dispersion (A1) in which crystalline resin/amorphous resin mixed particles having the volume average particle diameter of 158 nm are dispersed, and which has the solid concentration of 25% is prepared by putting 10 parts by weight of crystalline resin (A), 90 parts by weight of amorphous resin (1), 50 parts by weight of methyl ethyl ketone, and 15 parts by weight of isopropyl alcohol are put into the three-necked flask, dissolving the resin by heating at 60° C. while stirring, then adding 25 parts by weight of 10% ammonia aqueous solution into the three-necked flask, slowly adding further 400 parts by weight of ion exchange water into the three-necked flask to thereby perform a phase inversion emulsification, then reducing the pressure, and performing removing the solvent.

Preparation of Crystalline Resin/Amorphous Resin Mixed Particle Dispersion (A2)

An crystalline resin/amorphous resin mixed particle dispersion (A2) in which the crystalline resin/amorphous resin mixed particles having the volume average particle diameter of 155 nm are dispersed, and which has the solid concentration of 25% by weight is prepared in the same manner as in the preparation of the crystalline resin/amorphous resin mixed particle dispersion (A1) except that the amount of the crystalline resin (A) is changed from 10 parts by weight to 15 parts by weight, and the amount of the amorphous resin (1) is changed from 90 parts by weight to 85 parts by weight.

Preparation of Amorphous Resin Dispersion (A3)

An amorphous resin particle dispersion (A3) in which the crystalline resin/amorphous resin mixed particles having the volume average particle diameter of 175 nm are dispersed, and the solid concentration is 25% by weight is prepared in the same manner as in the preparation of the crystalline resin/amorphous resin mixed particle dispersion (A1) except that the amount of the crystalline resin (A) is changed from 10 parts by weight to 0 part by weight, and the amount of the amorphous resin (1) is changed from 90 parts by weight to 100 parts by weight.

Preparation of Toner 1

720 parts by weight of crystalline resin/amorphous resin mixed particle dispersion (A1), 50 parts by weight of the colorant dispersion, 70 parts by weight of the release agent dispersion, 0.9 parts by weight of ester compound dispersion, 2.5 parts by weight water glass (SNOWTEX OS (registered trademark) manufactured by Nissan Chemical Industries), and 1.5 parts by weight of cationic surfactant (SANISOL B50, prepared by Kao Corporation) are put into to a round stainless steel flask, 0.1 N sulfuric acid is added thereto to adjust pH to 3.8, 30 parts by weight of nitric acid aqueous solution having 10% by weight of concentration of polyaluminum chloride as coagulant is added into the flask, and then, the mixture is dispersed at 30° C. by using a homogenizer (ULTRA-TURRAX T50, manufactured by IKA Ltd.). The resultant is heated up to 40° C. at 1° C./min in oil bath for heating, held at 40° C. for 30 minutes, then 160 parts by weight of amorphous resin particle dispersion (A3) is slowly added into the dispersion, and further held for one hour.

After that, after adjusting pH to 7.0 by adding 0.1 N sodium hydroxide, the resultant is heated up to 95° C. at 1° C./min while continuously stirring, held for five hours, cooled up to 20° C. at speed of 20° C./min, filtrated, washed with ion exchange water, and then dried by a vacuum dryer so as to obtain a toner 1 having the volume average particle diameter of 6.1 μm.

Regarding the toner 1, the following physical property values are measured. The results are shown in Table 1 below.

Maximum value (tan $\delta_{P1}$) of mechanical loss tangent when the complex elastic modulus is in a range of $1\times10^6$ Pa to $1\times10^8$ Pa, which is measured at an angular frequency of 6.28 rad/sec and a strain amount of 0.3%

Maximum value (tan $\delta_{P2}$) of the mechanical loss tangent when the complex elastic modulus is in a range of $1\times10^6$ Pa to $1\times10^7$ Pa, which is measured at an angular frequency of 6.28 rad/sec and a strain amount of 0.3%

Dynamic complex viscosity ($\eta^*_{-3}$d at a temperature of (the melting temperature of the crystalline polyester resin contained in the toner −30° C.)

Dynamic complex viscosity ($\eta^*_{-10}$) at a temperature of (the melting temperature of the crystalline polyester resin contained in the toner −10° C.)

In addition, in all of the toners indicated in Table 1, 1.2 parts by weight of commercially available fumed silica RX50 (manufactured by Evonik Degussa Japan Co., Ltd., number average particle diameter: 40 nm) as an external additive is added to 100 parts by weight of toner by a Henschel mixer (Mitsui Miike Machinery Co., Ltd.) at a peripheral speed of 30 m/s for five minutes. Thereafter, 8 parts by weight of toner to which the external additive is added, and 100 parts by weight of carrier are mixed so as to prepare a two-component developer.

Note that, the carrier is obtained as follows.

14 parts by weight of toluene, and 2 parts by weight of styrene-methyl methacrylate copolymer (component ratio: styrene/methyl methacrylate=90/10, the weight average molecular weight Mw=80,000) are stirred with a stirrer for 10 minutes and dispersed to prepare a coating solution, and then the coating solution and 100 parts by weight of the ferrite particles (the volume average particle diameter: 50 μm) are put into a vacuum degassing-type kneader (manufactured by Inoue Mfg., Inc.), stirred at 60° C. for 30 minutes, the pressure is reduced while the mixture is further heated to preform degassing and drying, and then, the resultant is sieved with 105 μm to obtain a carrier.

Preparation of Toner 2

A toner 2 is prepared in the same manner as in the preparation of the toner 1 except that the content of the ester compound dispersion used in the preparing of the toner 1 is changed from 0.9 parts by weight to 2.7 parts by weight.

Preparation of Toner 3

A toner 3 is prepared in the same manner as in the preparation of the toner 1 except that the contents of the ester compound dispersion and the water glass, which are used in the preparing of the toner 1, are respectively changed from 0.9 parts by weight to 2.7 parts by weight, and from 2.5 parts by weight to 5.0 parts by weight.

Preparation of Toner 4

A toner 4 is prepared in the same manner as in the preparation of the toner 1 except that the crystalline resin/amorphous resin mixed particle dispersion (A1) used in the preparing of the toner 1 is changed to the crystalline resin/amorphous resin mixed particle dispersion (A2), and the contents of the ester compound dispersion and the water glass, which are used in the preparing of the toner 1, are respectively changed from 0.9 parts by weight to 2.7 parts by weight, and from 2.5 parts by weight to 5.0 parts by weight.

Preparation of Toner 5

A toner 5 is prepared in the same manner as in the preparation of the toner 4 except that the content of the ester compound dispersion which is used in the preparing of the toner 4 is changed from 2.7 parts by weight to 9 parts by weight.

Preparation of Toner 6

A toner 6 is prepared in the same manner as in the preparation of the toner 4 except that the contents of the ester compound dispersion and the water glass, which are used in the preparing of the toner 4, are respectively changed from 2.7 parts by weight to 9 parts by weight, and from 5.0 parts by weight to 15.0 parts by weight.

Various Measurements

The calculation of the mechanical loss tangent value is performed based on the dynamic viscoelasticity measured according to a sinusoidal vibration method. In the measurement of the dynamic viscoelasticity, a measuring apparatus ARES manufactured by Rheometric Scientific Inc is used, and the dynamic viscoelasticity is measured by setting a toner formed into a tablet is set on a parallel plate having a diameter of 8 mm, and imparting the sinusoidal vibration at a vibration frequency of 6.28 rad/sec to the plate after setting the normal force to be 0. The measurement is started at 60° C., and continued up to 150° C. The measurement time interval is set to be 30 seconds, the temperature rise is set to be 1° C./min, and the strain amount is set to be 0.3% so as to obtain the values of the complex elastic modulus and the mechanical loss tangent, and from the obtained values, the maximum value (tan Bpi) of the mechanical loss tangent when the complex elastic modulus is in a range of $1\times10^6$ Pa to $1\times10^8$ Pa, and the maximum value (tan $\delta_{P2}$) of the mechanical loss tangent when the complex elastic modulus is in a range of $1\times10^6$ Pa to $1\times10^7$ Pa are calculated.

The volume average particle diameter is measured using COULTER MULTISIZER TYPE II (manufactured by Beckman Coulter, Inc.) and ISOTON-II (manufactured by Beckman Coulter, Inc.) as the electrolytic solution. As a dispersion, 10 mg of a measurement sample is added into 2 ml of a 5 weight % aqueous solution of sodium dodecyl benzenesulfonate. The measurement sample added to 100 ml of the electrolytic solution is adjusted, and the electrolytic solution in which the measurement sample is suspended is dispersed for 1 minute by an ultrasonic disperser. Then, with COULTER MULTISIZER II, the particle diameter distribution of particles in a range of 2 μm to 60 μm is measured using an aperture having an aperture diameter of 100 μm to measure a volume average distribution. 50,000 particles are sampled. The cumulative distributions are drawn from the small particle side with respect to the particle diameter ranges (channels) separated based on measured particle distribution as the volume standard, and the particle diameter (D50v) when the cumulative percentage becomes 50% is defined as the volume average particle diameter of the measurement sample.

Evaluation

A modifier which contains the above-described developer in the developing device, and is modified by providing D136 Printer manufactured by Fuji Xerox Co., Ltd with a guide roller that guides the intermediate transfer belt and the photoreceptor by deforming the intermediate transfer belt such that the intermediate transfer belt and the photoreceptor are disposed along with each other is prepared.

Here, the rotational speed of the surface of the photoreceptor at the time of forming images is set to be 600 mm/s, and a fixing temperature by the fixing unit is set to be 175° C.

Further, a distance in which a portion of the surface of the image holding member and a portion of the surface of the intermediate transfer member are disposed along with each other by the guide roller is 10 mm.

Evaluation of transfer properties (evaluation of quality)

Patches having a halftone (30%, 40%, and 50%) in 100 mm×10 mm are collected, and the patch granularity (roughness of the image) is evaluated. As a sheet, 128 gsm of OSC paper manufactured by Fuji Xerox Co., Ltd is used. The results are indicated in Table 1.

Evaluation Criteria

A: No problem

B: Slight roughness is found

C: Roughness is remarkable

TABLE 1

| | Toner | $\tan\delta_{P1}$ | $\tan\delta_{P2}$ | $\eta^*_{-30}$ | $\eta^*_{-10}$ | Volume average particle diameter [μm] | Evaluation of transfer properties (Image quality) |
|---|---|---|---|---|---|---|---|
| Comparative Example 1 | Toner 1 | 1.9 | 1.8 | $9 \times 10^8$ | $3 \times 10^7$ | 6.1 | C |
| Example 1 | Toner 2 | 2.0 | 1.9 | $8 \times 10^8$ | $1.8 \times 10^7$ | 6.2 | B |
| Example 2 | Toner 3 | 2.2 | 2.1 | $6 \times 10^8$ | $1 \times 10^7$ | 6.4 | A |
| Example 3 | Toner 4 | 2.2 | 2.1 | $2 \times 10^8$ | $4 \times 10^6$ | 6.4 | A |
| Example 4 | Toner 5 | 2.5 | 2.3 | $9 \times 10^7$ | $8 \times 10^5$ | 6.0 | B |
| Comparative Example 2 | Toner 6 | 2.6 | 2.5 | $5 \times 10^7$ | $5 \times 10^5$ | 6.1 | C |

From the above-described results, it is understood that in Examples, the transfer properties of the toner image are prevented from being deteriorated, as compared with Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charge unit that charges a surface of the image holding member;

an electrostatic latent image forming unit that forms an electrostatic latent image on a charged surface of the image holding member;

a developing unit that contains a developer containing a toner, and develops the electrostatic latent image formed on the surface of the image holding member with the developer to form a toner image;

an intermediate transfer member of which the toner image is to be transferred to a surface;

a primary transfer unit that primarily transfers the toner image formed on the surface of the image holding member to the surface of the intermediate transfer member;

a second transfer unit that secondarily transfers the toner image transferred on the surface of the intermediate transfer member to a surface of a recording medium; and a guide unit that is provided on an upstream in the rotation direction of the intermediate transfer member from the primary transfer unit, and guides at least one of the image holding member and the intermediate transfer member up to a primary transfer position provided by the primary transfer unit such that a portion of the surface of the image holding member and a portion of the surface of the intermediate transfer member are disposed along with each other, wherein the toner contains a toner particle which contains a binder resin containing a crystalline polyester resin, a coloring agent and a releasing agent, and an external additive, and satisfies the following Expression (1):

$$2 \leq \tan \delta_{P1} \leq 2.5 \quad (1)$$

wherein $\tan \delta_{P1}$ represents a maximum value of a mechanical loss tangent existing in a range where a complex elastic modulus is from $1\times10^6$ Pa to $1\times10^8$ Pa, which is measured at an angular frequency of 6.28 rad/sec and a strain amount of 0.3%.

2. The image forming apparatus according to claim 1, wherein the maximum value ($\tan \delta_{P1}$) of the mechanical loss tangent of the toner is from 2 to 2.3.

3. The image forming apparatus according to claim 1, wherein the toner satisfies the following Expression (2):

$$2 \leq \tan \delta_{P2} \leq 2.3 \quad (2)$$

wherein $\tan \delta_{P2}$ represents a maximum value of a mechanical loss tangent existing in a range where a complex elastic modulus is from $1\times10^6$ Pa to $1\times10^7$ Pa, which is measured at an angular frequency of 6.28 rad/sec and a strain amount of 0.3%.

4. The image forming apparatus according to claim 3, wherein the maximum value ($\tan \delta_{P2}$) of the mechanical loss tangent of the toner is from 2 to 2.2.

5. The image forming apparatus according to claim 1, wherein a dynamic complex viscosity ($\eta^*_{-30}$) of the toner at a temperature of (a melting temperature of the crystalline polyester resin −30° C.) is $3\times10^7$ Pa·s or more, and an dynamic complex viscosity ($\eta^*_{-10}$) of the toner at a temperature of (a melting temperature of the crystalline polyester resin −10° C.) is from $1\times10^6$ Pa·s to $5\times10^7$ Pa·s.

6. The image forming apparatus according to claim 5, wherein the dynamic complex viscosity ($\eta^*_{-10}$) of the toner at a temperature of (the melting temperature of the crystalline polyester resin −10° C.) is from $2\times10^6$ Pa·s to $3\times10^7$ Pa·s.

7. The image forming apparatus according to claim 5, wherein the dynamic complex viscosity ($\eta^*_{-10}$) of the toner at a temperature of (a melting temperature of the crystalline polyester resin −10° C.) is from $4\times10^6$ Pa·s to $2\times10^7$ Pa·s.

8. The image forming apparatus according to claim 5, wherein the dynamic complex viscosity ($\eta^*_{-30}$) of the toner at a temperature of (a melting temperature of the crystalline polyester resin −30° C.) is $1\times10^8$ Pa·s or more.

9. The image forming apparatus according to claim 5, wherein the dynamic complex viscosity ($\eta^*_{-30}$) of the toner at a temperature of (a melting temperature of the crystalline polyester resin −30° C.) is $5\times10^8$ Pa·s or more.

10. The image forming apparatus according to claim 1, wherein a moving speed of a surface of the image holding member is 300 mm/s or more.

11. The image forming apparatus according to claim 1, wherein a distance where a portion of the surface of the image holding member and a portion of the surface of the intermediate transfer member are disposed along with each other by the guide unit is in a range of 5 mm to 10 mm.

* * * * *